US009851146B2

(12) United States Patent
Huber et al.

(10) Patent No.: US 9,851,146 B2
(45) Date of Patent: Dec. 26, 2017

(54) DRYER SECTION AND METHOD FOR DRYING A WEB OF FIBROUS MATERIAL, AND MACHINE HAVING SUCH A DRYER SECTION

(71) Applicant: PAPIERFABRIK AUGUST KOEHLER SE, Oberkirch (DE)

(72) Inventors: Manfred Huber, Oppenau-Ramsbach (DE); Joachim Uhl, Offenburg (DE); Lutz Kuhne, Ohlsbach (DE); Michael Boschert, Appenweier (DE)

(73) Assignee: Papierfabrik August Koehler SE, Oberkirch (DE)

( * ) Notice: Subject to any disclaimer, the term of this patent is extended or adjusted under 35 U.S.C. 154(b) by 0 days.

(21) Appl. No.: 14/431,428

(22) PCT Filed: Sep. 27, 2013

(86) PCT No.: PCT/DE2013/200177
§ 371 (c)(1),
(2) Date: Mar. 26, 2015

(87) PCT Pub. No.: WO2014/048431
PCT Pub. Date: Apr. 3, 2014

(65) Prior Publication Data

US 2015/0247669 A1 Sep. 3, 2015

(30) Foreign Application Priority Data

Sep. 28, 2012 (DE) ..... 10 2012 217 858

(51) Int. Cl.
*F26B 11/02* (2006.01)
*F26B 5/02* (2006.01)
(Continued)

(52) U.S. Cl.
CPC ..... *F26B 5/02* (2013.01); *D21F 5/006* (2013.01); *D21F 5/18* (2013.01); *F26B 21/001* (2013.01)

(58) Field of Classification Search
CPC ... F26B 11/00; F26B 11/02; F26B 5/02; B41J 11/00; B41J 11/02; B41J 11/002; D21F 11/00; D21F 5/00; D21F 5/18
(Continued)

(56) References Cited

U.S. PATENT DOCUMENTS 3,694,926 A 10/1972 Rodwin et al.
3,750,306 A 8/1973 Rodwin et al.
(Continued)

FOREIGN PATENT DOCUMENTS

DE 1031264 A 6/1958
DE 199 44 266 A1 3/2001
(Continued)

OTHER PUBLICATIONS

International Search Report for PCT/DE2013/200177, issued on Mar. 20, 2014.

*Primary Examiner* — Stephen M Gravini
(74) *Attorney, Agent, or Firm* — Zareefa B. Flener; Flener IP Law

(57) ABSTRACT

A dryer section for drying a web of fibrous material is provided, which has at least one drying unit for reducing the moisture content of the web by means of convection drying. The drying unit has at least one nozzle for applying a drying fluid to the web, at least one discharge device for the moist air produced during convection drying, and transport means for moving the web relative to the drying unit. The drying unit has at least one ultrasonic generator, which is arranged, for excitating vibrations in the drying fluid, in the region of the nozzle in such a manner that the reduction of the
(Continued)

moisture content by ultrasound can be supported over the entire width of the web.

16 Claims, 4 Drawing Sheets

(51) Int. Cl.
*D21F 5/00* (2006.01)
*D21F 5/18* (2006.01)
*F26B 21/00* (2006.01)

(58) Field of Classification Search
USPC ..... 34/497, 117, 121, 279; 162/207, 290
See application file for complete search history.

(56) References Cited

U.S. PATENT DOCUMENTS 3,999,302 A * 12/1976 Candor ..... B01D 21/0009 219/780
4,689,895 A * 9/1987 Taylor ..... D21F 7/003 34/114
5,669,159 A * 9/1997 Orloff ..... D21F 3/0272 162/206
6,475,571 B1 * 11/2002 Echigo ..... B05B 7/0012 427/256
6,701,637 B2 * 3/2004 Lindsay ..... D21F 5/004 162/206
8,756,825 B2 * 6/2014 Priebe ..... F26B 3/22 118/239
8,756,830 B2 * 6/2014 Priebe ..... B41J 11/002 118/239
9,068,775 B2 6/2015 Plavnik
9,096,079 B2 * 8/2015 Priebe ..... B41J 11/002
2010/0199510 A1 8/2010 Plavnik
2010/0206505 A1 * 8/2010 Clarahan ..... D21F 5/024 162/207
2015/0247669 A1 * 9/2015 Huber ..... D21F 5/006 34/279

FOREIGN PATENT DOCUMENTS

DE 19944266 A1 3/2001
DE WO 2014048431 A3 * 5/2014 ..... D21F 5/006
DE 10 2012 217 858 A1 6/2014
DE 102012217858 A1 * 6/2014 ..... D21F 5/006
EP 1 092 060 B1 8/2003
RU 2335588 C2 7/2005
SU 427216 A1 5/1974
WO 00/19007 A1 4/2000
WO 2010/090690 A1 8/2010
WO 2014/048431 A2 4/2014

* cited by examiner

DRYER SECTION AND METHOD FOR DRYING A WEB OF FIBROUS MATERIAL, AND MACHINE HAVING SUCH A DRYER SECTION

The invention relates to a dryer section for drying a web of fibrous material having the features of the preamble of claim 1. A dryer section of this type is, for example, known from DE 199 44 266 A1. The invention also relates to a method for drying a web of fibrous material and to a machine having a dryer section.

The dryer section of a paper machine is arranged between the press section, which dewaters the material web in a mechanical manner, and a rolling apparatus, which rolls up the dried web. The dryer section has the object of thermally removing the moisture remaining in the web after the mechanical dewatering down to the desired final moisture content. Steam-heated cylinders are traditionally used for this purpose, the material web being guided over said cylinders. In the case of these dryer sections based on the principle of contact drying, the heat required to remove the moisture is introduced by the drying cylinder into the material web. DE 199 44 266 furthermore describes the use of drying or nozzle hoods, which are arranged along the running direction of the material web in the dryer section. Hoods of this type are used to apply a hot fluid to the material web and work according to the principle of convection drying.

The energy that has to be used to dry the paper web is an important cost factor in paper production. The dry content is generally in a range from 45% to 98%. This cost factor will be all the more important in the foreseeable future if one considers that energy saving will form a central requirement for the paper industry because of generally increasing energy prices. There is also the fact that the dryer section of a paper machine has the greatest space requirement of the entire paper machine. To this extent, the dryer section is a limiting factor not only with regard to the energy requirement but also with regard to the space requirement.

The invention is therefore based on the object of disclosing a dryer section for drying a web of fibrous material, especially of paper, cardboard, tissue/sanitary paper, which is improved with respect to energy efficiency. The invention is furthermore based on the object of disclosing a corresponding method for drying a web of fibrous material and a machine with such a dryer section.

According to the invention, this object is achieved by a dryer section having the features of claim 1. With regard to the method, the object is achieved by the subject of claim 13 and, with regard to the machine, by the subject of claim 11.

According to the invention, a dryer section for drying a web of fibrous materials, especially of paper, cardboard, tissue/sanitary paper, is proposed, comprising at least one drying unit for reducing the moisture content of the web by convection drying. The drying unit has at least one nozzle for applying a drying fluid to the web. The dryer section furthermore has a discharge device for the moist air being produced during the convection drying and a transport means to move the web relative to the drying unit. The drying unit has a least one ultrasound generator, which is arranged in the region of the nozzle to excite vibrations of the drying fluid in such a way that the reduction in the moisture content for the entire web thickness can be assisted by ultrasound. The dryer section is preferably provided for a machine for producing a web of fibrous material.

A significant increase in the drying efficiency, i.e. the energy usage per weight unit of water removed, is possible using the invention compared to the prior art. The invention therefore has a significant economic potential, becoming correspondingly more important with increasing energy prices. As well as the advantage of the low energy consumption when using the dryer section according to the invention, the high investment costs typical of the sector are reduced as, owing to the invention, a small outlay for machine construction is required to produce the dryer section or the paper machine with a dryer section of this type. If the dryer section of an existing system is retrofitted according to the invention for ultrasound-assisted drying, there is also the advantage due to the small space requirement of the invention that, at a predetermined size of the system, an increase in the overall drying output is brought about and thus an increase in the machine output can be achieved.

The improvement in the drying output is achieved by the ultrasound generator provided according to the invention, which is used to make the drying fluid leaving the nozzle of the drying unit vibrate. The acoustic vibrations of the drying fluid prevent or reduce the formation of an air cushion on the web to be dried, which would hinder the convection flow. Therefore, a relatively large fluid quantity impinges directly on the web. The dryer section according to the invention is configured in such a way that it does not only make possible a dehumidification of the web surface. Rather, the dryer section according to the invention is configured in such a way that the moisture content over the entire web thickness can be brought to the desired final moisture content, the reduction in the moisture content being able to be assisted by ultrasound. The dryer section according to the invention thus allows a thorough drying of the entire web in the thickness direction with the assistance of ultrasound.

It is assumed—without being committed to this action principle—that applying ultrasound to the web involves a double effect. On the one hand, as already mentioned, the moisture-saturated air cushion over the web is disturbed by the acoustic excitement of the drying fluid in such a way that unsaturated air or, in general, unsaturated drying fluid can follow. Thus, more water can escape from the web overall. In addition, there is possibly a second effect, which is based on the fact that the ultrasound vibrations are introduced into the web material and excite the fibrous structure of the web. It is assumed that the water contained in the web material is additionally thereby mechanically discharged.

The method according to the invention is based on the fact that to dry the web of fibre material, especially of fibre, cardboard, tissue/sanitary paper, the web is moved through the dryer section and at least partially convectively dried, the moisture content of the web being reduced. Ultrasound waves are applied to the web during the drying process in such a way that the reduction in the moisture content over the entire web thickness is assisted by ultrasound. Thus, in the method according to the invention, as in the dryer section according to the invention, the convection flow is acoustically excited, so a cushion with saturated air forming on the web is disturbed and the convection flow can impinge substantially unhindered on the web. The moisture content over the entire web thickness is also reduced in the method according to the invention, the reduction taking place assisted by ultrasound. In the method, not only does a surface drying take place, but a thorough drying of the entire web. Reference is made in this context to the statements on the dryer section according to the invention.

In a preferred embodiment of the dryer section according to the invention, one or more ultrasound-assisted drying units and further drying units are combined. The further drying units may, for example, be at least one drying cylinder and/or at least one device for infrared drying and/or at least one air hood. In general, this means that the ultrasound-assisted drying units can be combined with units, which are based on the principle of contact drying and/or convection drying and/or infrared drying. As a result, an increase in the drying output of conventional drying units is achieved, which can take place both within the framework of retrofitting an existing system and in the framework of a new assembly.

Alternatively, it may be that ultrasound-assisted drying units are exclusively provided. These may be arranged on one side and/or on both sides and/or on alternate sides along the web to be dried, the web being stabilised by web stabilising or web guiding aids in a manner known per se. This means that in the framework of this embodiment according to the invention, it is also possible in an extreme case to construct the entire dryer section according to the principle of ultrasound-assisted convection drying.

The transport means expediently have guides for the web, especially guide rollers, wherein one or more ultrasound-assisted drying units being arranged in the open draw between the guides. The ultrasound-assisted drying units can thus be used flexibly and do not imperatively have to be combined with other drying units, known per se. As a result, the design possibilities for the individual assemblies of the dryer section are expanded.

The transport means preferably have a continuously movable carrier for the web, wherein one or more ultrasound-assisted drying units are arranged in the region of the carrier. The carrier may, for example, be a conveyor belt, a screen belt or a wire mesh. Other carriers are possible. The advantage of this embodiment is that the ultrasound-assisted drying units are substantially not tied to a position and can therefore be associated with system elements, such as, for example, the continuously movable carrier for the web. In this case, the ultrasound-assisted drying units may be arranged on the carrier side and/or the free web side. The drying units may be arranged on one side and/or on both sides and/or alternate sides.

A pre-drying and/or post-drying of the web before running through drying units known per se can be achieved in that one or more ultrasound-assisted drying units are arranged in the open draw before and/or after further units, especially drying units, such as a drying cylinder and/or a device for infrared drying and/or an air hood.

In a further preferred embodiment, the ultrasound-assisted drying units are arranged on one side and/or both sides in an opposing manner and/or alternating on both sides, in relation to the web. The arrangement on one side may be sufficient when using powerful ultrasound-assisted drying units to allow a thorough drying of the web over the entire web thickness. The arrangement of the ultrasound-assisted drying units on both sides in an opposing manner and/or alternating on both sides leads to the fact that the drying fluid excited by ultrasound can be applied to the web from both sides, so the thorough drying of the web takes place especially uniformly from both sides. In this case, the use of comparatively low-power drying units is possible, but not imperative.

A further example of the usability of the drying units with flexible positions consists in that one or more ultrasound-assisted drying units are arranged along the entire wrap region, or a part thereof, of the web of at least one roller and/or at least one cylinder. The cylinder expediently comprises a drying cylinder with an air hood, which at least partially, especially completely, surrounds the wrap region of the drying cylinder.

The dryer section may have a control, which is adjusted in such a way that the final moisture content of the web is a maximum of 15%, preferably a maximum of 10%. The term "thorough drying" relates to the final moisture content adjusted over the entire web thickness.

According to the independent claim 11, the dryer section is part of a machine for producing a web of fibrous material, comprising inter alia a device for mechanically dewatering the web, in particular a press section, the dryer section being arranged downstream of the device for mechanically dewatering in the transport direction of the web. In this case, the dryer section may be a size press and/or a coating unit and/or a smoothing unit and/or a device for rolling the web.

It is preferably provided in the method according to the invention that the fibrous material has a wet strengthening agent, especially a melamine resin or a urea formaldehyde resin or an epichlorohydrin resin. Materials of this type, for the purpose of condensation of the wet strengthening resin, need over-drying, in other words an extensive removal of the water. An adequately high web temperature is necessary for this during the drying. The method according to the invention, in which the moisture content over the entire web thickness is reduced by ultrasound-assisted convection drying, is therefore especially attractive in conjunction with the use of wet strengthening agents because the reduction in the water content of the web to below the level of the finished paper web requires a particularly high energy usage especially during the removal of the residual water at low moisture contents. The method according to the invention is not limited to the drying of webs with a fibrous material, which has a wet strengthening agent, but merely provides special advantages here.

The invention will be described in more detail below with reference to the accompanying schematic drawings, in which:

FIG. 1 shows a dryer section 20 according to an example according to the invention, which is part of a paper machine. The dryer section 20 may also be part of a machine for producing tissue or sanitary paper or part of a machine for producing cardboard webs.

The dryer section 20 is arranged between a press section and a rolling apparatus. The paper machine may be equipped with or without smoothing unit(s) and/or with/without a size or film press and/or an on-line coating unit. The aforementioned assemblies may be arranged downstream of the dryer section in the running direction of the web. The dryer section 20 is distinguished by ultrasound-assisted drying units 11, with the aid of which the moisture content of the web together with the further drying units of the dryer section is brought to the desired final moisture content.

The object of the dryer section 20 is to bring the paper web taken over by the press section to the desired final moisture content. The final moisture content may be in a range from about 2 to 15%, especially in a range from about 2 to 10%, especially about 2 to 8%, especially about 2 to 6%, especially about 2 to 4%. In general, contact drying, convection drying and infrared drying are possible for drying, the convection drying being intensified in the dryer section 20 according to FIG. 1 by the excitation of the drying fluid at an ultrasound frequency. In other words, the drying fluid, for example hot air or hot steam, is sprayed at ultrasound frequency onto the wet paper web leaving the press section.

Figure 7:
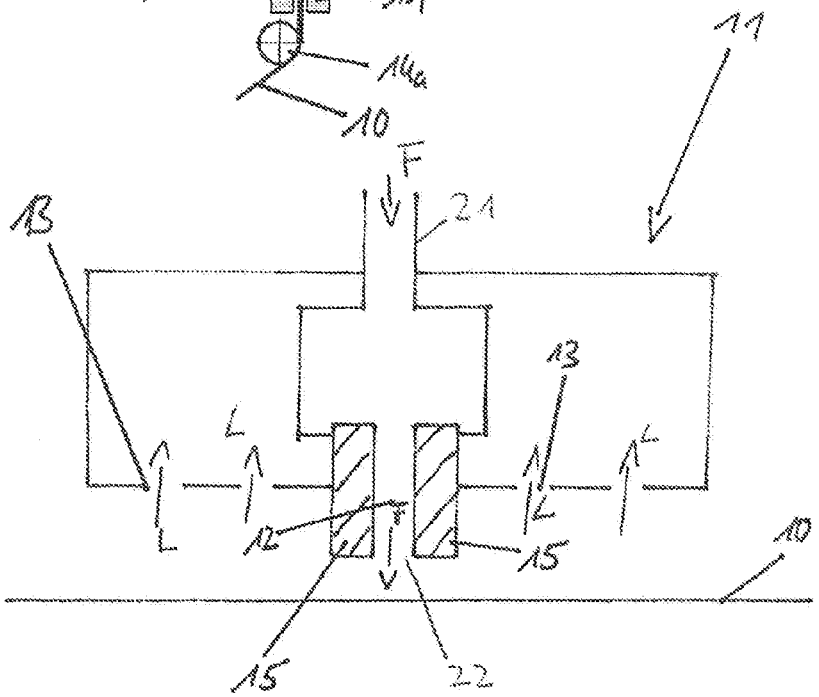
FIG. 7 shows a simplified cross section through an ultrasound-assisted drying unit.

An example of an ultrasound-assisted drying unit 11 used for this is shown schematically in FIG. 7. The drying unit 11 has a nozzle 12, which is directed onto the surface of the paper web 10, so the drying fluid flow leaving the nozzle 12 impinges on the web 10. The nozzle 12 extends transverse to the longitudinal direction of the web. The width of the nozzle 12 substantially corresponds to the width of the web to be dried so the desired final moisture content over the entire web width can be adjusted. The nozzle 12 can be configured as a slot nozzle, the slot extending transverse to the longitudinal direction of the web. The nozzle 12 may be configured as a perforated plate with one or more rows of holes, which extend transverse to the longitudinal direction of the web in each case. The nozzle 12 is connected to a fluid supply 21, by which the drying fluid can be fed to the nozzle 12. The fluid flow is designated by the arrows F in FIG. 7.

The drying unit 11 has a discharge device 13, through which the moist air being produced during the drying is discharged. The air flow is designated by the arrows L. In the simplest case, the discharge device 13 is configured as a perforated plate or as a slotted plate, the openings of which in each case extend transverse to the longitudinal direction of the web. A separate arrangement of the discharge device separately from the drying unit 11 is possible.

A particular feature of the drying unit 11 is the ultrasound generator 15, which is used to apply an ultrasound frequency to the drying fluid leaving the nozzle 12. In the embodiment according to FIG. 7, the nozzle walls are configured for this purpose as an ultrasound generator 15. In other words, the ultrasound generator 15 is integrated into the nozzle 12 so the drying fluid flowing through the nozzle 12 passes the ultrasound generator 15 and is made to carry out ultrasound vibrations.

The drying output of the drying unit 11 is adapted in such a way that a paper web with a conventional web thickness can be dehumidified over the entire web thickness, so the desired final moisture content can be adjusted. It is not only a question of drying the upper side of the web 10 facing the nozzle 12 in an ultrasound-assisted manner, but, rather, the drying unit 11 has the function of achieving the reduction in the moisture over the entire web thickness, so the advantage of reduced energy usage comes to the fore.

It is assumed that an amplitude of the ultrasound waves on the surface of the web 10 is effective in the range from about 120 dB to about 190 dB, especially in the range from about 140 dB to about 190 dB, especially in the range from about 160 dB to about 190 dB, especially in the range from about 160 dB to about 185 dB. The spacing required for this between the outlet opening of the nozzle 12 and the surface of the web 10 is adjusted by the person skilled in the art. The spacing between the outlet opening 22 of the nozzle 12 and the nozzle-side web surface can also be determined with the aid of the wavelength, the spacing approximately corresponding to ($\lambda$) (n/4), wherein $\lambda$ is the wavelength of the ultrasound vibration and n is ±0.5 of an uneven whole number.

In this case, n in each case comprises a range, for example 0.5 to 1.5, 2.5 to 3.5, 4.5 to 5.5, etc. Preferably, n is an uneven whole number (1, 3, 5, 7 etc.). This means that the amplitude of the ultrasound vibration reaches its maximum approximately at the web surface in order to as effectively as possible disturb the buffer layer forming over the web.

To adjust the spacing between the outlet opening 22 and the web surface, an adjusting face may be provided, which is arranged opposite the outlet opening 22. The adjusting face (not shown) guides the web to be dried at the desired spacing from the outlet opening 22. The adjusting face may, for example, be a flat plate, the web being guided over the face by means of a carrier belt. Alternatively, the adjusting face may be formed by one or more rollers, on which the web is directly guided, or by a carrier belt, which supports the web (without an adjusting plate). Other embodiments of the adjusting face are possible. To adjust the spacing between the outlet opening 22 and the web surface, other adjusting mechanisms may be provided, additionally or alternatively, for example a positioning means for changing the position of the outlet opening 22 relative to the web surface.

With reference to FIGS. 1 to 6, various possibilities will be described below as to how the ultrasound-assisted drying units 11 can be positioned with reference to conventional drying units. In general, the ultrasound-assisted drying units can be used in combination with conventional drying units, which are based on the principle of contact drying and/or convection drying and/or infrared drying. The ultrasound-assisted drying units 11 can be arranged instead of, in front of, behind or between conventional or possible drying units in the dryer section. The aforementioned position details relate to the running direction of the web. The drying units, which are combined with ultrasound-assisted drying units 11, can be cylinders heated with different heat carriers (for example water, steam, heat transfer oil), infrared dryers of air hoods.

Figure 1:
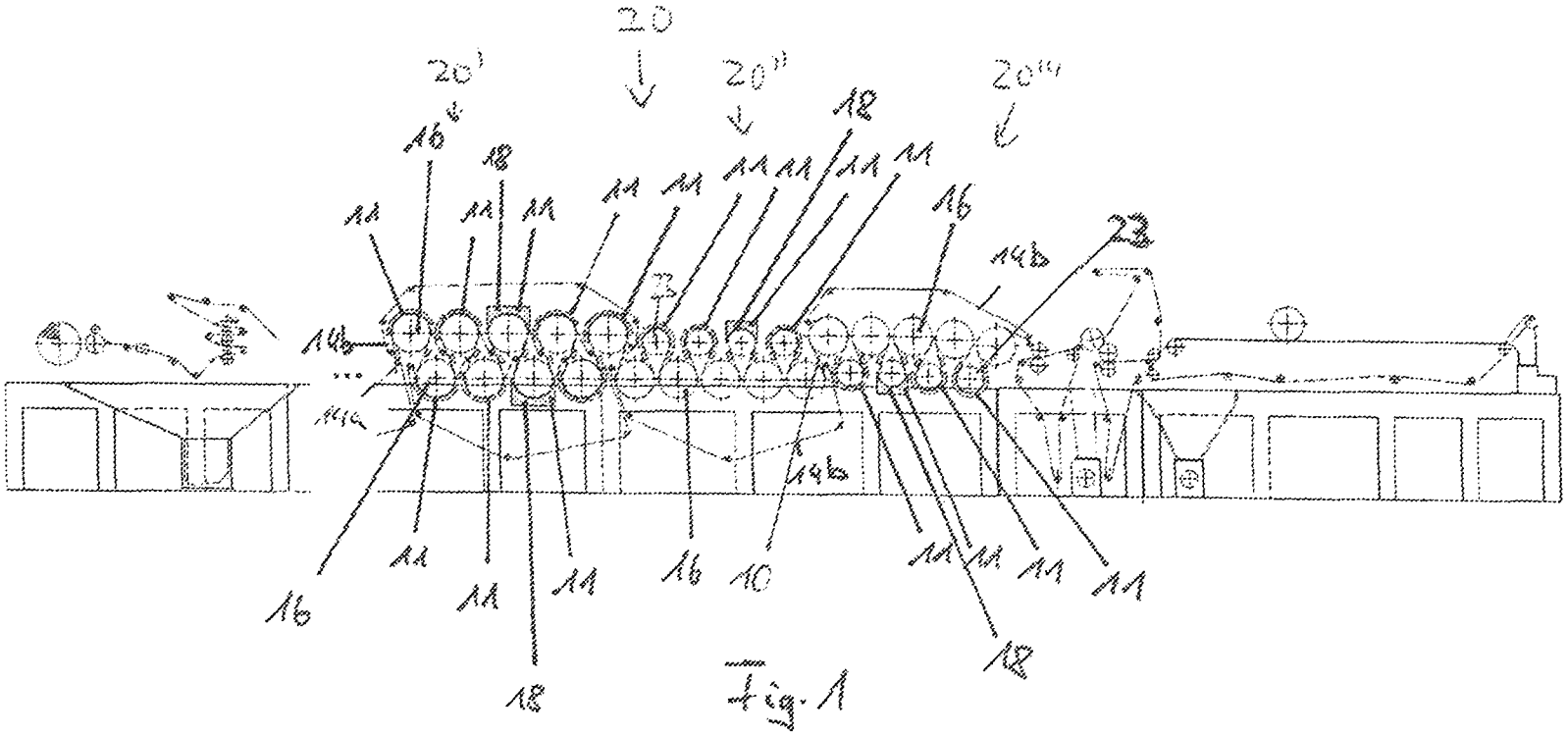
FIG. 1 shows a side view of a dryer section according to an embodiment according to the invention.
Figure 2:
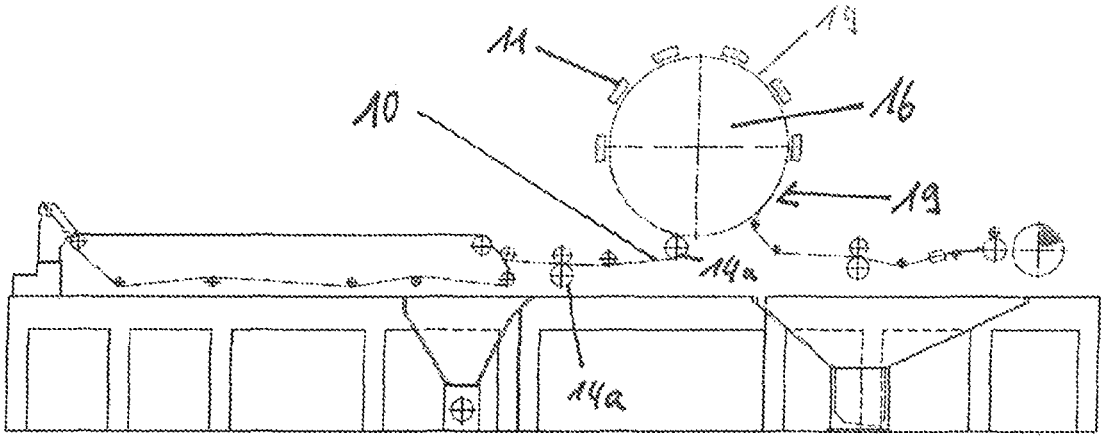
FIG. 2 shows a side view of a drying cylinder, which is combined with ultrasound-assisted drying units.

As shown in FIG. 1, the ultrasound-assisted drying units may be associated with the cylinder assembly of a double-row dryer section 20'. It is also possible, as shown in FIG. 1, to integrate the ultrasound-assisted drying units in an assembly of a single-row dryer section with vacuum rollers arranged at the top (see here reference numeral 20") or vacuum rollers arranged at the bottom (see here reference numeral 20"). The drying units 11 may be associated with the vacuum rollers and/or the drying cylinders. By combining the ultrasound-assisted drying units 11 with the vacuum rollers 23, a particularly effective utilisation of the installation space of the dryer section is achieved.

The following positions of the ultrasound-assisted drying units 11 in the dryer section 20 are possible, without the invention being limited thereto.

Figure 4:
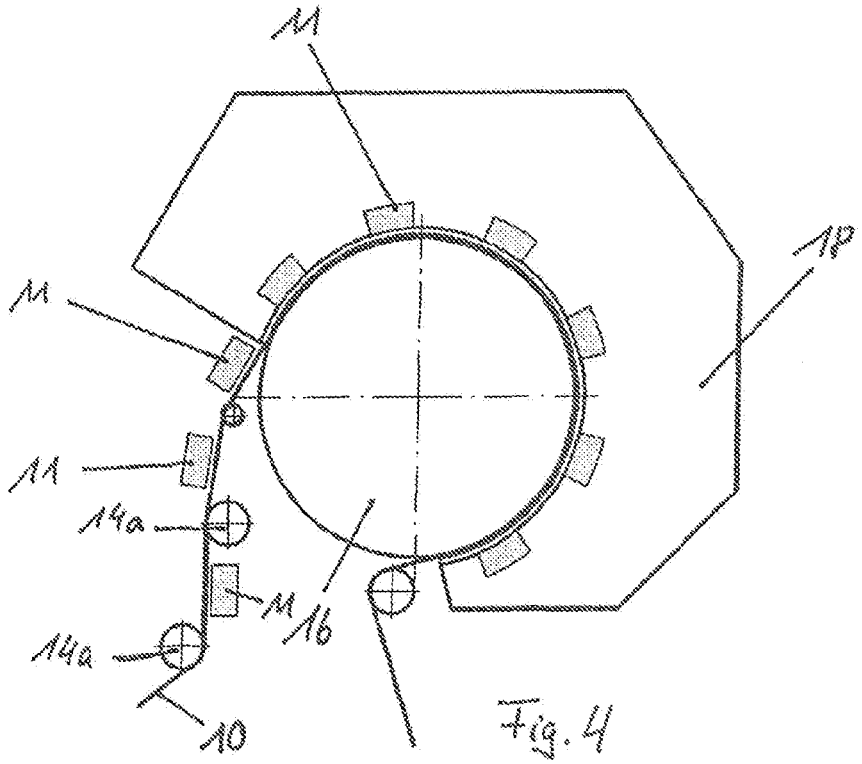
FIG. 4 shows a side view of a drying cylinder with an air hood, in which additional ultrasound-assisted drying units are arranged in the open draw in front of the air hood.

As shown in FIGS. 1 and 4, the drying units 11 may be arranged in the open draw between two web guide aids, such as, for example, paper guide rollers or, in general, in the open draw between guides 14*a*. The drying units 11 may be arranged on one side and/or both sides and/or alternate sides, as shown in FIG. 4, in each case in relation to the web 10. A further possibility for arranging the drying units consists in providing, as disclosed in FIGS. 1 and 2, the drying units 11 in the wrap region 19 of cylinders, such as, for example, drying cylinders 16, vacuum cylinders 23 or paper guide rollers. The drying unit may be arranged over the entire wrap region 19 or partially over the wrap region 19 (see here also FIGS. 4, 5). The drying units 11 may extend continuously along the periphery of the cylinder or be arranged distributed on the periphery of the cylinder.

Figure 3:
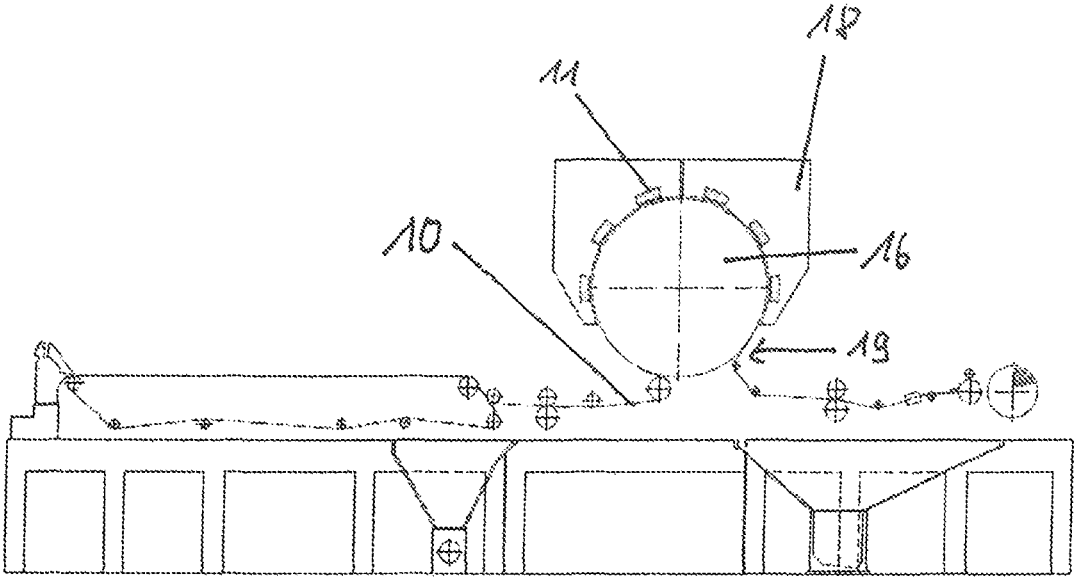
FIG. 3 shows a side view of a drying cylinder with an air hood, in which a plurality of ultrasound-assisted drying units is integrated.
Figure 5:
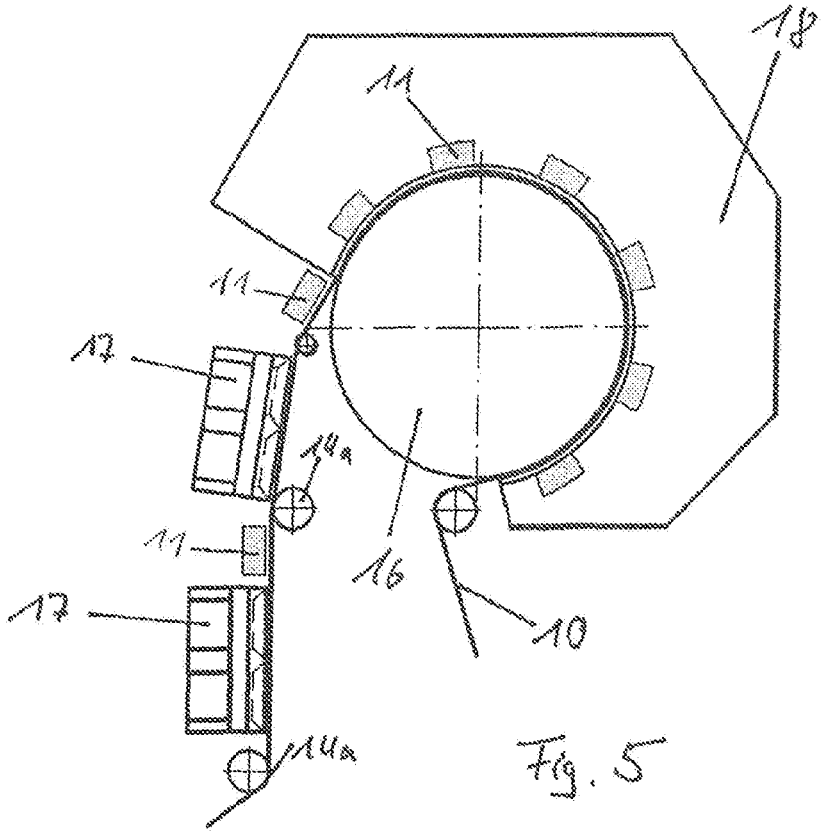
FIG. 5 shows the drying cylinder according to FIG. 4, which is additionally equipped with devices for infrared drying, the devices for infrared drying being arranged on one side.
Figure 6:
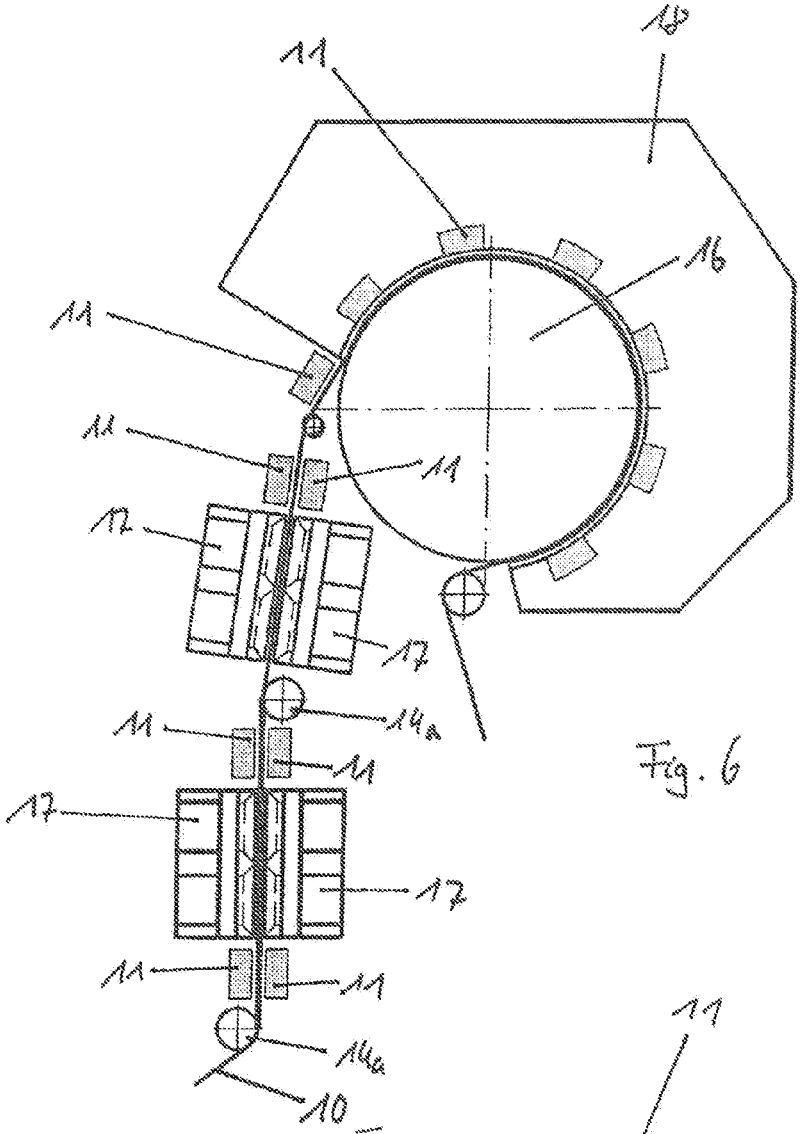
FIG. 6 shows the drying cylinder according to FIG. 5, the devices for infrared drying as well as the ultrasound-assisted drying units being arranged on both sides.

It is possible to guide a carrier web, such as a drying screen or a drying felt, between the drying units 11 and the web 10 without the mode of action of the ultrasound-assisted drying units 11 being significantly impaired here. The drying screen is designated by the reference numeral 14*b* in FIG. 1 (in general carrier). As shown in FIG. 3, the drying cylinder 16 can additionally be surrounded by a high-power hood or in general, an air hood 18 (see here also FIGS. 4, 5 and 6). The drying units 11 are integrated in the air hood. A further combination possibility is shown in FIGS. 5, 6. Accordingly, the drying units 11 may be combined with devices for infrared drying 17, the devices 17 being able to be arranged on one side (FIG. 5) or both sides (FIG. 17). Accordingly, the ultrasound-assisted drying units 11 may also be arranged on one side (FIG. 5) or both sides (FIG. 6). It is obvious that the drying units 11 may be arranged on the same side as the devices 17 (FIG. 5). In both examples according to FIGS. 5, 6, the drying units 11 are arranged in the open draw before and/after the devices for infrared drying 17.

A further example of the arrangement of the drying units 11 is to assemble these in the region in which the web 10 is guided on a carrier 14*a*, 14*b*. The carrier may, for example, be a conveyor band, a conveyor belt, a screen belt, a wire mesh, paper guide rollers, vacuum rollers etc.

In summary, at least one drying unit, in particular a plurality of drying units, may thus be combined with heated drying cylinders 16 and/or with infrared dryers 17 and/or with air hoods 18. It is also possible to exclusively provide ultrasound-assisted drying units 11, i.e. without additional conventional drying units.

The absolute number of respectively required drying units 11 in the dryer section depends on the water quantity to be removed per time unit and is a function of the grammage, web speed, web width, web moisture on entering the dryer section and final moisture of the web. The person skilled in the art accordingly selects the respectively required number of drying units according to the respective circumstances.

The arrangement possibilities of the drying units mentioned above according to FIGS. 1 to 6 may be combined with one another.

The above-described features of the various embodiments of the dryer section are also disclosed in connection with the drying method that can be carried out using the respective embodiments. In the framework of the method, the ultrasound-assisted convection drying is carried out in such a way that a reduction in the moisture content over the entire web thickness takes place. In this case, the convection flow excited by ultrasound can be applied to the web 10 on one side and/or both sides and/or alternate sides. In cases where an over-drying of the web, in other words a reduction in the water content of the web to below the level of the finished paper web is required, the advantage of the energy saving particularly comes to the fore. The residual water at low moisture contents is removed here in the rear region of the dryer section. Over-drying is used, for example, for the purpose of condensation of a wet strengthening resin.

The invention will be described below with reference to the independent claim 15. Accordingly, the dryer section with the features of the preamble of claim 15 is distinguished in that the drying unit has at least one ultrasound generator, which is formed by the nozzle and a fan that feeds the drying fluid to the nozzle. The nozzle and the fan cooperate to excite the vibrations of the drying fluid in such a way that the drying fluid is made to vibrate in the ultrasound range when flowing through the nozzle. The nozzle and the fan thus together form the ultrasound generator without further additional components that are required to excite the vibrations being necessary for this. The excitation of the vibrations takes place similarly to in a dog whistle known per se, which works in the ultrasound range. For this purpose, the flow parameters are adjusted in such a way that, for example, the fluid pressure and the shape of the nozzle are adapted in such a way that the drying fluid leaving the nozzle vibrates at a frequency in the ultrasound range.

All the embodiments according to the sub-claims and the embodiments mentioned in the above description are disclosed and claimed in conjunction with the ultrasound generator consisting of the nozzle and the fan. In conjunction with the dryer section according to the independent claim 15 it is disclosed in general form that the ultrasound generator consists of the nozzle and the fan.

The embodiment according to claim 17, according to which the nozzle is directed onto the surface of the web during operation, is also disclosed and claimed in conjunction with all the claims and in conjunction with all the embodiments of the description. The advantage of this embodiment is that the drying fluid is applied directly to the surface of the web.

LIST OF REFERENCE NUMERALS

10 web
11 drying unit
12 nozzle
13 discharge device
14*a* guides
14*b* carrier
15 ultrasound generator
16 drying cylinder
17 device for infrared drying
18 air hood
19 wrap region
20 dryer section
20', 20", 20''' assemblies of the dryer section
21 fluid supply
22 outlet opening
23 vacuum rollers
F fluid
L air

The invention claimed is:

1. A dryer section for drying a web of fibrous material, especially of paper, cardboard, tissue/sanitary paper comprising;

at least one drying unit for reducing moisture content of a web by means of convection drying, wherein the at least one drying unit has at least one nozzle for applying a drying fluid to the web;

at least one discharge device for moist air being produced during the convection drying; and transport means to move the web relative to the at least one drying unit;

wherein the drying unit has at least one ultrasound generator, which is arranged, to excite vibrations of the drying fluid, in a region of the at least one nozzle, wherein the at least one nozzle is configured in such a way that vibration excited drying fluid is directed onto the web and that a drying output of the at least one drying unit is adapted in such a way that in such a way that reduction in the moisture content over an entire web thickness can be assisted by ultrasound.

2. The dryer section according to claim 1, wherein one or more ultrasound-assisted drying units and further drying units, with at least one drying cylinder with at least one device for infrared drying with at least one air hood, are combined.

3. The dryer section according to claim 1, wherein exclusively ultrasound-assisted drying units are provided.

4. The dryer section according to claim 1, wherein the transport means has guides for the web, with guide rollers, wherein one or more ultrasound-assisted drying units are arranged in an open draw between guides.

5. The dryer section according to claim 1, wherein the transport means has a continuously movable carrier for the web, including a conveyor belt, a screen belt or a wire mesh, wherein one or more ultrasound-assisted drying units are arranged in a region of the continuously movable carrier.

6. The dryer section according to claim 1, wherein one or more ultrasound-assisted drying units are arranged in an open draw before or after further one or more ultrasound-assisted drying units, as a drying cylinder or a device for infrared drying or an air hood.

7. The dryer section according to claim 1, wherein the ultrasound-assisted drying units are arranged on one side or both sides in an opposing manner or alternating on both sides in relation to the web.

8. The dryer section according to claim 1, wherein at least one roller or at least one cylinder, which each form a wrap region of the web, wherein one or more ultrasound-assisted drying units are arranged along an entire wrap region or a part thereof.

9. The dryer section according to claim 8, wherein the at least one drying cylinder comprises a drying cylinder with an air hood, which at least partially, surrounds the wrap region of the at least one drying cylinder.

10. The dryer section according to claim 1, wherein a control, which is adjusted in such a way that a final moisture content of the web is a maximum of 15%.

11. A machine for producing a web of fibrous material comprising:

a device for mechanically dewatering the web, with a press section; and a dryer section according to any one of the preceding claims, which is arranged downstream of the device for mechanically dewatering in a transport direction of the web.

12. The machine according to claim 11, wherein a size press or a coating unit or a smoothing unit or a device for rolling the web are arranged downstream of the dryer section.

13. A method for drying a web of fibrous material, especially of paper, cardboard, tissue/sanitary paper, comprising:

moving the web through a dryer section; and drying the web convectively to reduce moisture content of the web, wherein a drying fluid directed from a nozzle onto the web and vibration excited by ultrasound waves is applied to the web during a drying process in such a way that reduction in moisture content over an entire web thickness is assisted by ultrasound.

14. The method according to claim 13, wherein the fibrous material has a wet strengthening agent, with a melamine resin or a urea formaldehyde resin or an epichlorohydrin resin.

15. A dryer section for drying a web of fibrous material, especially of paper, cardboard, tissue/sanitary paper comprising:

at least one drying unit for reducing the moisture content of the web by means of convection drying, wherein the at least one drying unit has at least one nozzle for applying a drying fluid to the web;

at least one discharge device for moist air being produced during convection drying; and transport means to move the web relative to the drying unit;

wherein the at least one drying unit has at least one ultrasound generator, which is formed by the at least one nozzle and a fan, which feeds the drying fluid to the at least one nozzle, wherein the at least one nozzle and the fan cooperate to excite vibrations of the drying fluid in such a way that the drying fluid is excited to carry out vibrations in an ultrasound range when flowing through the at least one nozzle, and wherein the at least one nozzle is configured to direct vibration excited drying fluid onto the web.

16. A dryer section according to claim 15 or claim 1, wherein the at least one nozzle is directed onto the surface of the web during operation.

* * * * *